US008203282B2

(12) United States Patent
Yamamoto et al.

(10) Patent No.: US 8,203,282 B2
(45) Date of Patent: Jun. 19, 2012

(54) ELECTRONIC BALLAST WITH LAMP END OF LIFE DETECTION AND PROTECTION CIRCUITS

(75) Inventors: Masafumi Yamamoto, Osaka (JP); Tetsuya Hamana, Nara (JP); Hiroyuki Asano, Nara (JP)

(73) Assignee: Panasonic Corporation, Osaka (JP)

( * ) Notice: Subject to any disclaimer, the term of this patent is extended or adjusted under 35 U.S.C. 154(b) by 428 days.

(21) Appl. No.: 12/491,994

(22) Filed: Jun. 25, 2009

(65) Prior Publication Data

US 2010/0001649 A1 Jan. 7, 2010

(30) Foreign Application Priority Data

Jun. 25, 2008 (JP) ..... 2008-166218

(51) Int. Cl.
*H05B 37/02* (2006.01)

(52) U.S. Cl. ..... 315/291; 315/309

(58) Field of Classification Search ..... 315/291, 315/294, 297, 307, 309
See application file for complete search history.

(56) References Cited

U.S. PATENT DOCUMENTS

| | | | | |
|---|---|---|---|---|
| 6,696,798 | B2 * | 2/2004 | Nishimoto et al. | 315/224 |
| 7,109,665 | B2 * | 9/2006 | Green | 315/224 |
| 2010/0096995 | A1 * | 4/2010 | Kishimoto | 315/119 |
| 2010/0109548 | A1 * | 5/2010 | Matsuda | 315/279 |

FOREIGN PATENT DOCUMENTS

JP 2007172933 7/2007

* cited by examiner

*Primary Examiner* — Don Le
(74) *Attorney, Agent, or Firm* — Waddey & Patterson, P.C.; Mark J. Patterson; Gary L. Montle

(57) ABSTRACT

An electronic ballast A includes an inverter circuit for converting a DC voltage into a high-frequency voltage, a resonant circuit which is connected between outputs of the inverter circuit and lights a discharge lamp at a high frequency by a resonant action, a dimming circuit for changing an output voltage to the discharge lamp by changing an operating frequency of the inverter circuit, a DC component detecting circuit for detecting a DC voltage component of the discharge lamp and a control operating circuit which detects an output signal of the DC component detecting circuit for every predetermined period to reduce or stop an output to the discharge lamp in the case where the output signal exceeds a predetermined reference value and to prohibit the protection operation when periodic change amount in the output signal reaches a predetermined value or higher.

5 Claims, 11 Drawing Sheets

ELECTRONIC BALLAST WITH LAMP END OF LIFE DETECTION AND PROTECTION CIRCUITS

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: Japanese Patent Application No. JP2008-166218 filed on Jun. 25, 2008.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates to electronic ballasts and lighting fixtures using an electronic ballast.

Electronic ballasts for lighting a discharge lamp at a high frequency are well known in the art (see e.g., Japanese Unexamined Patent Publication No. 2007-17293). FIG. 10 is a circuit diagram of a one embodiment of an electronic ballast in which a half-bridge type inverter circuit 1 having two switching elements Q1, Q2 is provided and a series circuit formed of the switching elements Q1, Q2 is connected between both ends of a DC power source Vdc. A series resonant circuit 2 including a resonant inductor T1 and a capacitor C1 is connected between a connection point of the switching elements Q1, Q2 and a ground GND of the DC power source Vdc.

A discharge lamp FL as a load is connected between both ends of the resonant capacitor C1 via a resonant and DC blocking capacitor C2. One filament F1 of the discharge lamp FL is connected to a preheating circuit 3 including a serial circuit of an inductor L1 and a capacitor C3 and a preheating source n1, and the other filament F2 is connected to the preheating circuit 3 including a serial circuit of an inductor L2 and a capacitor C4 and a preheating source n2. The preheating sources n1, n2 are set to have the same operating frequency.

In the electronic ballast of this embodiment, when a dimming signal from a dimming circuit 8 is inputted to a frequency control circuit 5, the frequency control circuit 5 determines the operating frequency of the switching elements Q1, Q2 and the switching elements Q1, Q2 are alternately turned on/off at the determined operating frequency by a driving circuit 6. By converting a DC voltage of the DC power source Vdc into a high-frequency voltage by alternately turning on/off the switching elements Q1, Q2 and passing an alternating current through the discharge lamp FL, the discharge lamp FL is lighted at the high frequency. The resonant circuit 2 including the inductor T1 and the capacitors C1, C2 is connected in the path to the discharge lamp FL and energy fed to the discharge lamp FL can be adjusted according to a relationship between the operating frequency of the switching elements Q1, Q2 and a resonant frequency of the resonant circuit 2.

A DC component detecting circuit 7 is connected to the discharge lamp FL such that when a positive or negative DC voltage component is present in the discharge lamp FL, an output signal corresponding to the DC voltage is outputted to a voltage comparator EL. In the case where the voltage comparator EL outputs a low signal, the inverter circuit 1 continues its operation and in the case where the voltage comparator EL outputs a high signal, the output of the inverter circuit 1 is reduced or stopped by controlling the operating frequency of the switching elements Q1, Q2.

When the discharge lamp FL reaches an end of life (EOL) state and an emitter (emissive material) of one filament F1 (or filament F2) is depleted, causing a half-wave discharge state (so-called emission-less state), a DC voltage component occurs in the discharge lamp FL and the DC component detecting circuit 7 outputs an output signal corresponding to the DC voltage component. Then, the output signal from the DC component detecting circuit 7 is inputted to the voltage comparator EL and when this value exceeds a reference value Vref, the voltage comparator EL outputs a high signal and the output of the inverter circuit 1 is reduced or stopped for circuit protection.

In the EOL detection and protection circuits of FIG. 10, even if the operating frequencies of the preheating sources n1, n2 are the same, the resonant frequency of the preheating circuits 3 varies due to variation in the inductors L1, L2 and the capacitors C3, C4. For this reason, a phase difference between continuous preheating currents in the filament F1, F2 in the case where a dimming level changes is generated, resulting in deviation of hot spot positions on the filaments F1, F2. Since a DC voltage component is generated in the high-frequency voltage occurring in the discharge lamp FL due to the deviation of hot spot positions of the filaments F1, F2, even when the lamp at end of life is not connected, it can be erroneously detected that the discharge lamp is at the end of life due to the DC voltage component and a circuit protection function is performed.

Thus, in this example the following method is used to prevent such a malfunction. When the dimming signal for changing the operating frequency is inputted from the dimming circuit 8 to the frequency control circuit 5, a dimming signal detecting circuit 9 detects a change in the dimming signal and outputs a detecting signal to a timer circuit 11. When the timer circuit 11 receives the signal from the dimming signal detecting circuit 9, the timer circuit 11 outputs an ON signal for turning on a switch SW1 (for example, transistor) to the driving circuit 10 for a predetermined time to turn on the switch SW1 for the predetermined time. By turning on the switch SW1, a signal from the DC component detecting circuit 7 is fixed at a low level for the predetermined time.

FIG. 11 shows a timing chart in this example. Since the dimming signal detecting circuit 9 does not detect a change in the dimming signal in the case where the dimming level is not changed, the switch SW1 is not turned on. For this reason, since the signal from the DC component detecting circuit 7 is inputted to the voltage comparator EL as it is, EOL circuit protection is possible in the case where the discharge lamp FL at the end of life is connected.

On the contrary, when a change in the dimming level is rapid, after the change in the dimming signal is completed, the DC voltage component of the discharge lamp FL can be inputted to the voltage comparator EL depending on a time constant of the DC component detecting circuit 7. However, in the case where a delay time of the timer circuit 11 is sufficiently longer than the time constant of the DC component detecting circuit 7, since the timer circuit 11 outputs the ON signal to the driving circuit 10 even when the DC voltage component of the discharge lamp FL is inputted after the change in the dimming signal, the above-mentioned detection error can be prevented.

The electronic ballast disclosed in Japanese Unexamined Patent Publication No. 2007-17293 prohibits operation of the DC component detecting circuit 7 for a predetermined time in the case where the dimming level changes, thereby preventing EOL detection errors due to the DC voltage component caused during a change in the dimming level.

However, when the dimming level changes, the DC voltage component is not necessarily generated and when the dimming level is moderately changed, the DC voltage component is not generated. Accordingly, in the case where a change in the dimming level is relatively small, the dimming level is minutely changed by using a brightness sensor or the like and the dimming level changes due to an external noise, the DC voltage component is not generated. However, since the above-mentioned electronic ballast prohibits a detecting operation of the DC component detecting circuit 7 at change in the dimming level, there are cases where the DC voltage component occurring at the end of life of the discharge lamp FL cannot be detected and thus, a circuit cannot be protected.

TABLE 1

| Dimming level [%] | Maximum peak value [V] | Number of sets |
|---|---|---|
| 90-80 | 1.49 | 2 |
| 80-70 | 1.59 | 3 |
| 70-60 | 1.84 | 4 |
| 60-50 | 1.81 | 7 |
| 50-40 | 1.90 | 9 |
| 40-30 | 1.40 | 6 |
| 30-20 | 0.78 | 2 |

FIG. 12 and Table 1 show measurement results of the DC voltage component generated at both ends of the discharge lamp in the case where the dimming level is changed, in a dual lamp serial lighting-type electronic ballast. A peak value of the DC voltage component occurring in the discharge lamp in the case where the dimming level is changed from Dim lighting (25% dimmed lighting) to Full lighting (100% lighting) at about 300 ms and a dimming level at the peak value are measured by changing a connecting direction of the discharge lamp. The measurement results are shown for each dimming level and a peak value and N pieces of data in the case where a largest DC voltage component is superimposed at each dimming level are shown.

From FIG. 12 and Table 1, the magnitude of the DC voltage component and a dimming level at which the DC voltage component is superimposed vary depending on variation in the individual discharge lamps and the connecting direction. In this measurement, 66 discharge lamps of FHF24SEN type, FHF24SEW type and FHF24SEL type (33 sets) are used to make measurement at normal temperature and humidity.

In this example, a time during which operation of the DC component detecting circuit 7 is prohibited depends on the type of the discharge lamp and the time constant of the DC component detecting circuit 7. However, as described above, even in the same type of discharge lamps, the magnitude of the DC voltage component occurring in the discharge lamp varies depending on variation in characteristics and environmental conditions such as the speed of the change in dimming level, the number of lamps, the connecting direction and temperature, and timing of occurrence of the DC voltage component and duration when a voltage value exceeds the reference voltage value vary. Accordingly, in this example, it is necessary to set duration when operation of the DC component detecting circuit 7 is prohibited to be sufficiently long. As a result, in the case where the dimming level changes, a protection operation is prohibited for a predetermined time even if the operation of the DC component detecting circuit 7 need not be prohibited. Thus, disadvantageously, a period when the end of life of the discharge lamp FL cannot be detected becomes long.

Furthermore, in this example, to prevent malfunction of the EOL protection circuit at end of life, a control circuit 4 takes a longer time than the change time of the dimming signal by the dimming circuit 8 to change the output of the discharge lamp FL. As a matter of course, when the change time of the dimming signal becomes long, the time to change the output of the discharge lamp FL also becomes longer, resulting in that performance with respect to a dimming operation can be impaired.

BRIEF SUMMARY OF THE INVENTION

In consideration of the above-mentioned problems, an object of the present invention is to provide a electronic ballast which prevents malfunction of the EOL protection circuit without impairing performance with respect to the dimming operation and without impairing EOL detection, and a lighting fixture using thereof.

A first aspect of the present invention is characterized in that an electronic ballast includes an inverter circuit with at least one switching element for converting a DC voltage into a high-frequency voltage, a resonant circuit for lighting a discharge lamp at a high frequency by resonant action, the resonant circuit being connected to the inverter circuit, a control circuit for controlling an operation of the inverter circuit, dimming circuit adapted to change an output voltage to the discharge lamp by changing an operating frequency of the inverter circuit, DC component detecting circuit adapted to detect a DC voltage component of the discharge lamp, protecting circuit adapted to detect an output signal of the DC component detecting circuit for every predetermined period and controlling the switching element so as to reduce or stop an output to the discharge lamp when the output signal exceeds a predetermined reference value, and operation prohibiting circuit adapted to prohibit operation of the protecting circuit when a periodic change in the output signal of the DC component detecting circuit reaches a predetermined value or higher.

A second aspect of the present invention is characterized in that the operation prohibiting circuit prohibits an operation of the protecting circuit until the output signal falls below the predetermined reference value in the case where the periodic change amount in the output signal reaches a predetermined value or higher and the output signal exceeds the predetermined reference value, and prohibits the operation of the protecting circuit until the periodic change in the output signal becomes negative in the case where the periodic change in the output signal reaches the predetermined value or higher and the output signal does not exceed the predetermined reference value.

A third aspect of the present invention is characterized in that the operation prohibiting circuit predicts a peak value of the output signal on the basis of the periodic change amount of the output signal and sets the predetermined reference value to be higher than the predicted peak value in a period when the output signal exceeds the predetermined reference value.

A fourth aspect of the present invention is characterized in that the control circuit, the protecting circuit and the operation prohibiting circuit is formed of one integrated circuit component.

A fifth aspect of the present invention is characterized in that the electronic ballast described as to any of the first to fourth aspects of the present invention is built in a lamp fixture main body.

According to the first aspect of the present invention, since a protection operation can be prevented by prohibiting a protection operation of the protecting circuit in the case where a periodic change amount in an output signal outputted from the DC component detecting circuit reaches a predetermined value or higher even if the discharge lamp is not at the end of life, the electronic ballast with improved detection accuracy of the end of life can be advantageously provided. Moreover, since a protection operation is prohibited only in the case where the periodic change in the output signal from the DC component detecting circuit reaches the predetermined value or higher, a shorter period to prohibit the protection operation and resulting in setting a longer period to detect the end of life can be achieved. Thereby, it is possible to realize a function to detect lamp EOL without impairment. There is a further effect of suppressing a performance reduction with respect to a dimming operation since it is unnecessary to change an output of the discharge lamp over a longer period than the change time of the dimming signal, as in the other EOL circuits, in order to prevent malfunction of a protection function.

According to the second aspect of the present invention, since the period to prohibit the protection operation can be shortened while suppressing an erroneous detection, it is effectively possible to set a longer period to detect the end of life of the discharge lamp than that in the first aspect of the present invention.

According to the third aspect of the present invention, by resetting the predetermined reference value to be higher than the peak value predicted based on the periodic change amount in the output signal, when the detected DC voltage component exceeds the reset predetermined reference value, it is determined that the filament is broken and the circuit protection operation is activated.

According to the fourth aspect of the present invention, since the number of circuits can be reduced by forming the control circuit, the protecting circuit and the operation prohibiting circuit as one integrated circuit component compared to forming them separately, the number of assembling steps can be reduced, resulting in that the electronic ballast can be provided while suppressing cost increase.

According to the fifth aspect of the present invention, by using the electronic ballast described in any of the first to fourth aspects of the invention, it is effectively possible to provide a lighting fixture which can prevent malfunction of the protection function at lamp EOL while suppressing a performance reduction with respect to the dimming.

DETAILED DESCRIPTION OF THE INVENTION

Embodiments of an electronic ballast and a lighting fixture according to the present invention will be described below referring to FIGS. 1 to 9. The electronic ballast according to the present invention is used to light a discharge lamp forming the lighting fixture at a high frequency and the lighting fixture according to the present invention is, for example, a lighting fixture for ceiling mounting and is used to illuminate a room interior and the like.

Figure 1:
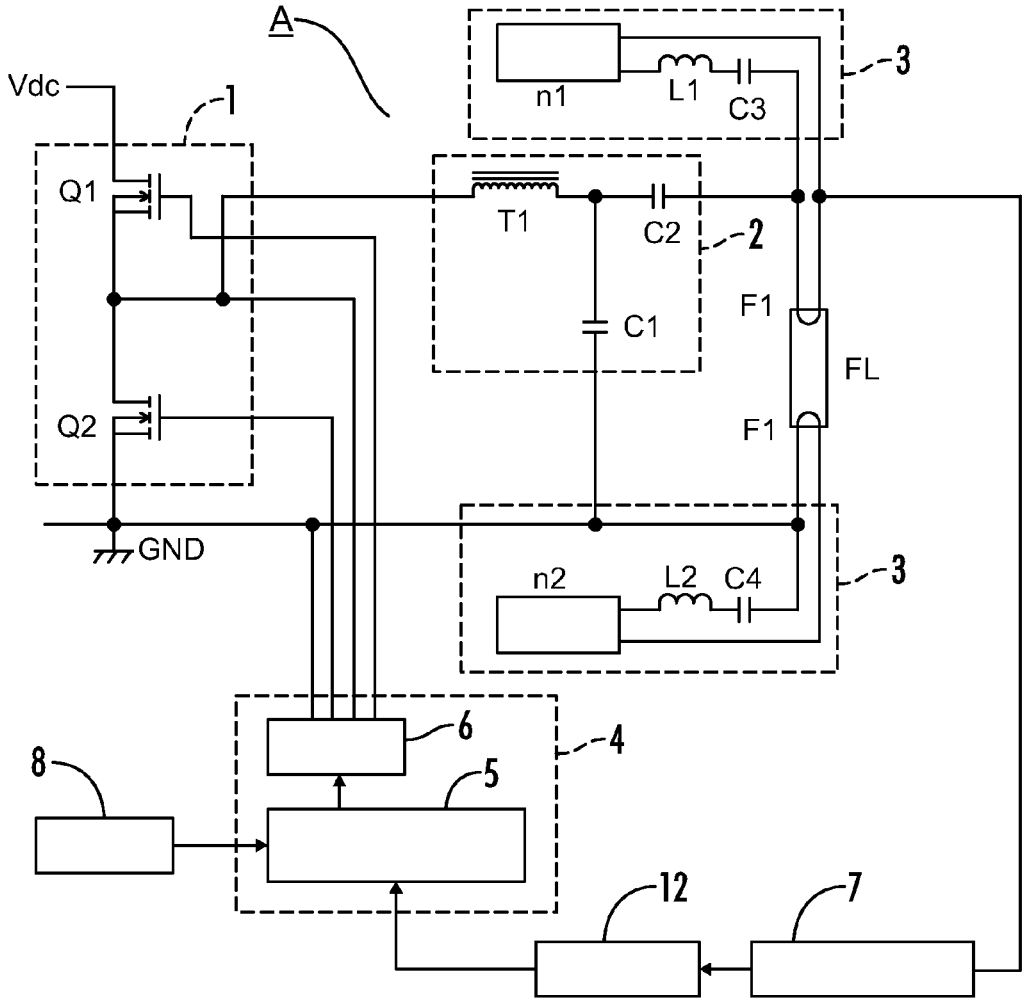
FIG. 1 is a circuit diagram showing a first embodiment of an electronic ballast in accordance with the present invention.

FIG. 1 is a circuit diagram showing an electronic ballast A in accordance with a first embodiment, in which a half-bridge type inverter circuit 1 formed of two switching elements Q1, Q2 is provided. The switching elements Q1, Q2 is connected between the output terminals of a DC power source Vdc. A resonant circuit 2 formed of a resonant inductor T1 and a capacitor C1 is connected between a connection point of the switching elements Q1, Q2 and a ground GND of the DC power source Vdc. A discharge lamp FL as a load is connected across capacitor C1 via a resonant and DC blocking capacitor C2.

One filament F1 of the discharge lamp FL is connected to a preheating circuit 3 having a series circuit formed of an inductor L1 and a capacitor C3 and a preheating source n1. The other filament F2 is connected to the preheating circuit 3 having a series circuit formed of an inductor L2 and a capacitor C4 and a preheating source n2. In the present embodiment, the preheating sources n1, n2 are set to have a same operating frequency.

The electronic ballast A in the present embodiment has a dimming function and when a dimming signal from a dimming circuit 8 is coupled to a frequency control circuit 5, the frequency control circuit 5 determines the operating frequency of the switching elements Q1, Q2. The switching elements Q1, Q2 are alternately turned on/off at the determined operating frequency by a driving circuit 6. By converting a DC voltage of the DC power source Vdc into a high-frequency voltage by alternately turning on/off the switching elements Q1, Q2 and passing an alternating current through the discharge lamp FL, the discharge lamp FL is lighted at a high frequency.

In the present embodiment, since the resonant circuit 2 formed of the inductor T1 and the capacitors C1, C2 is connected to an electric feeding path to the discharge lamp FL, energy fed to the discharge lamp FL can be adjusted depending on a relationship between the operating frequencies of the switching elements Q1, Q2 and a resonant frequency of the resonant circuit 2. In the present embodiment, the frequency control circuit 5 and the driving circuit 6 form a control circuit 4.

Moreover, a DC component detecting circuit 7 is connected to the discharge lamp FL in parallel and when detecting a DC voltage component occurring in the discharge lamp FL, the DC component detecting circuit 7 outputs a detecting signal corresponding to the detected DC voltage component to a control operating circuit 12.

The control operating circuit 12 is formed of, for example, a microprocessor, reads an output signal from the DC component detecting circuit 7 for every predetermined period, carries out a predetermined operation based on the read data and outputs a signal to the frequency control circuit 5 according to an operation result. For example, in the case where the output signal of the control operating circuit 12 is low, the inverter circuit 1 continues its operation. In the case where the output signal is high, an output of the inverter circuit 1 is reduced or stopped by controlling the frequency control circuit 5 to adjust an operating frequency of the inverter circuit 1.

In the case where the output signal from the DC component detecting circuit 7 exceeds a reference value Vref previously stored in the microprocessor, the control operating circuit 12 outputs a high signal and protects the inverter circuit 1 as described above. On the other hand, in the case where a periodic change in the output signal from the DC component detecting circuit 7 for every predetermined period reaches or exceeds a predetermined value previously stored in the microprocessor, the control operating circuit 12 determines that the detected DC voltage component is not a DC voltage component at the end of life. In this state, even when the output signal exceeds the reference value Vref, it outputs a low signal and does not protect the inverter circuit 1 as described above. Hereinafter, this state is referred to as an abnormal DC component superimposed state.

In the present embodiment, when the output signal from the DC component detecting circuit 7 exceeds the reference value Vref after determination as the abnormal DC component superimposed state, the inverter circuit 1 is not protected until the output signal falls below the reference value Vref. Furthermore, in the case where the output signal does not exceed the reference value Vref after determination as the abnormal DC component superimposed state, the inverter circuit 1 is not protected until a periodic change amount in the output signal becomes negative. In the present embodiment, the control operating circuit 12 forms a protecting circuit and operation prohibiting circuit.

Figure 2:
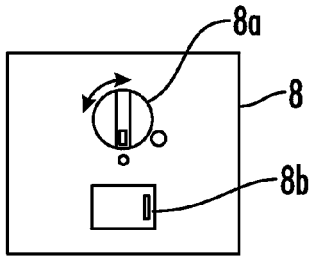
FIG. 2 is a front view of a dimming control used in with the present invention.

FIG. 2 shows one embodiment of a dimming circuit 8 which includes a rotary dimming control 8*a* and a switch 8*b*. The rotary control 8*a* enables continuous dimming control by continuously varying a dimming signal from a dimming lower limit level to a full lighting level. The switch 8*b* can switch lighting between the dimming lower limit level and the full lighting level by turning on/off the switch. That is, the dimming circuit 8 for adjusting the dimming level may enable continuous dimming control, switch lighting between the dimming lower limit level and the full lighting level or enable phased dimming control. In the present embodiment, when dimming control is performed using the switch 8*b*, lighting can switch between the dimming lower limit level and the full lighting level in about 300 ms.

Figure 3:
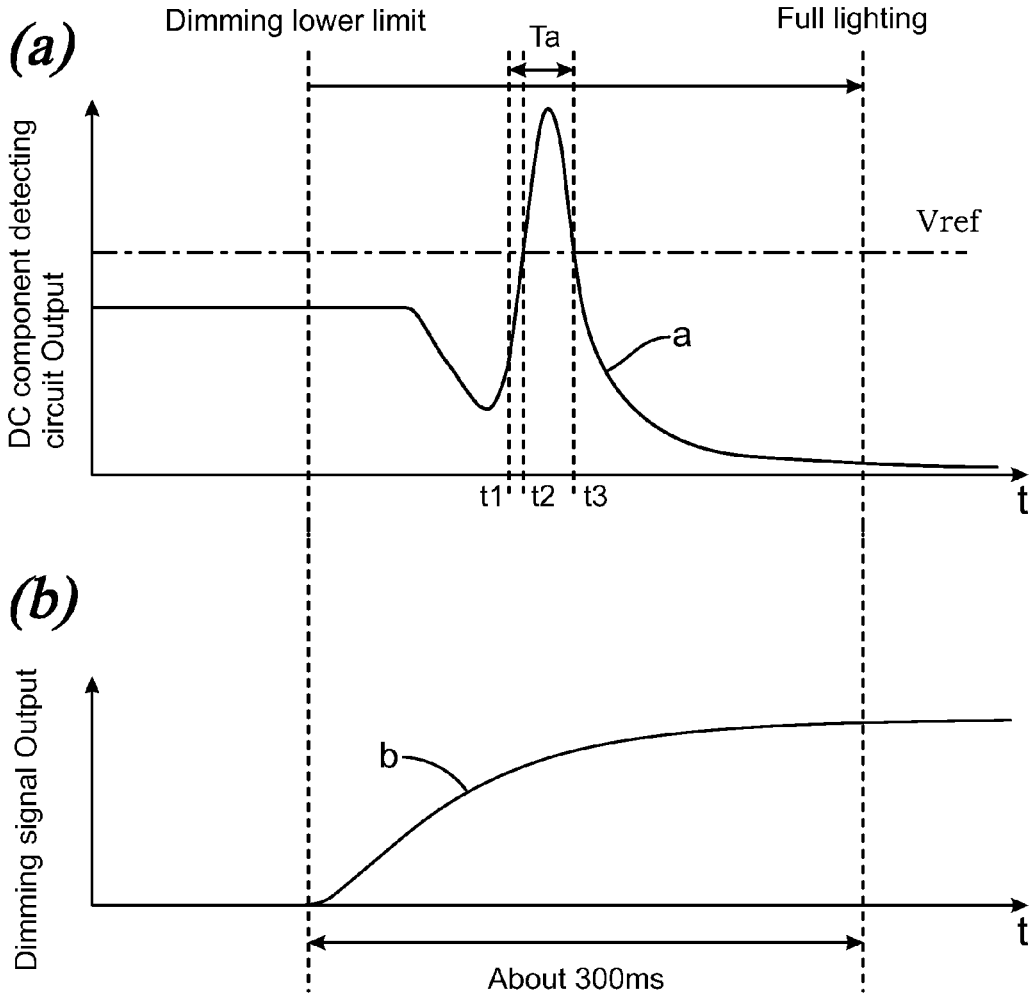
FIGS. 3(*a*) and 3(*b*) are signal timing charts for the embodiment of FIG. 1.

FIG. 3 shows an output waveform of each circuit at the time when the dimming level of the discharge lamp FL is switched from the dimming lower limit level to the full lighting level by the switch 8*b*. FIG. 3(*a*) shows the output signal from the DC component detecting circuit 7 and FIG. 3(*b*) shows the dimming signal from the dimming circuit 8. In the figure, as represented by a solid line a, a periodic change in the output signal reaches a predetermined value or higher at time t1 and the above-mentioned protection operation is prohibited from that time. Then, an output signal exceeds a reference value Vref at time t2 and falls below the reference value Vref at time t3. That is, in the case shown in FIG. 3, the protection operation is prohibited in a period Ta from time t1 to time t3. At this time, as represented by a solid line b in FIG. 3(*b*), the dimming signal changes from the dimming lower limit level to the full lighting level in about 300 ms.

Figure 4:
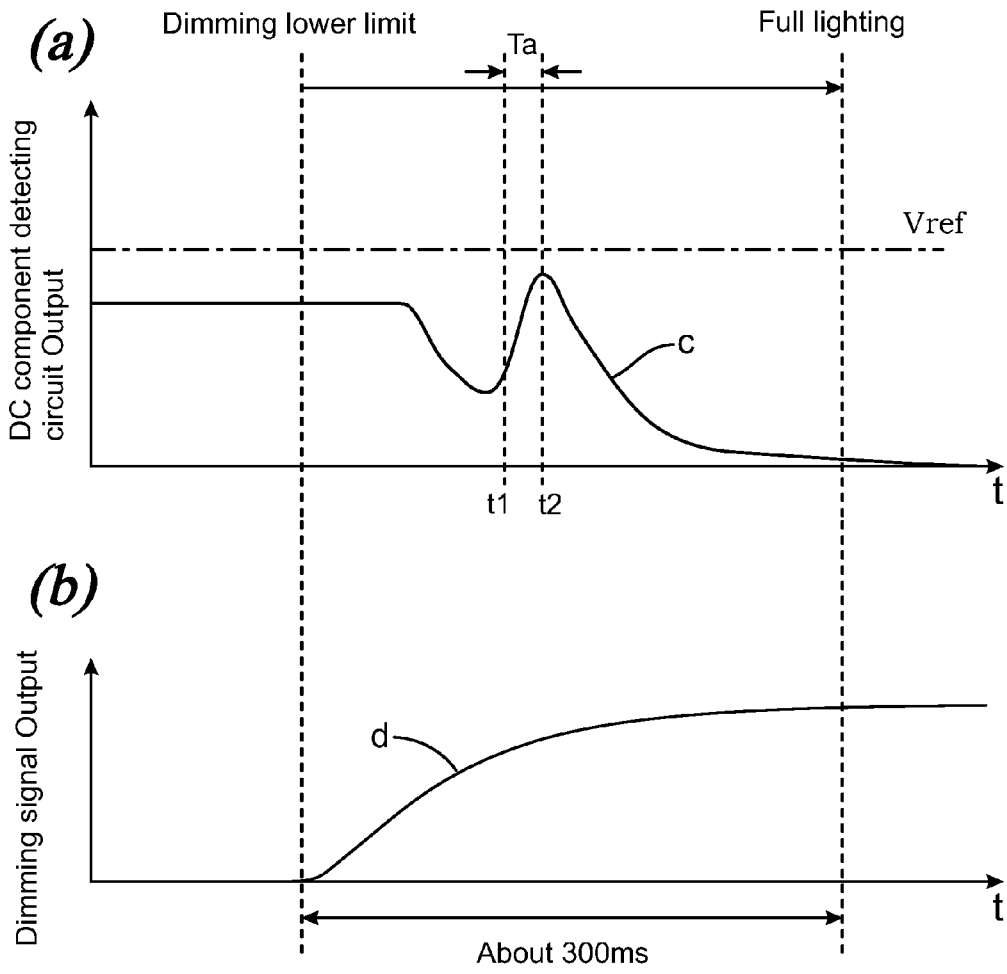
FIGS. 4(*a*) and 4(*b*) are signal timing charts for the embodiment of FIG. 1.

FIG. 4 shows the case where the output signal from the DC component detecting circuit 7 does not exceed the reference value Vref in the state where the dimming level is changed from the dimming lower limit level to the full lighting level. In the figure, as represented by a solid line c, the periodic change in the output signal reaches the predetermined value or higher at time t1 and the above-mentioned protection operation is prohibited from that time. Then, the periodic change in the output signal becomes negative at time t2 without the output signal exceeding the reference value Vref. That is, in the case shown in FIG. 4, the protection operation is prohibited in a period Ta from time t1 to time t2. At this time, as represented by a solid line d in 4(*b*), the dimming signal changes from the dimming lower limit level to the full lighting level in about 300 ms.

TABLE 2

| Dimming level start value [%] | DC voltage component peak value [V] |
|---|---|
| 25 | 9.6 |
| 30 | 7.8 |
| 35 | 6.2 |
| 40 | 0 |

A method of setting the predetermined value as a threshold value of the periodic change in the output signal will be described. Table 2 shows a start value of the dimming state in the case where lighting is switched from the dimmed state to the full lighting state by switch 8*b* and measurement results of a peak value of the DC voltage component corresponding to the start value. The DC voltage component is not superimposed in the case where the start value of the dimming level is 40% and the DC voltage component of 6.2V or higher is superimposed when the start value of the dimming level is 35% or lower.

Figure 5:
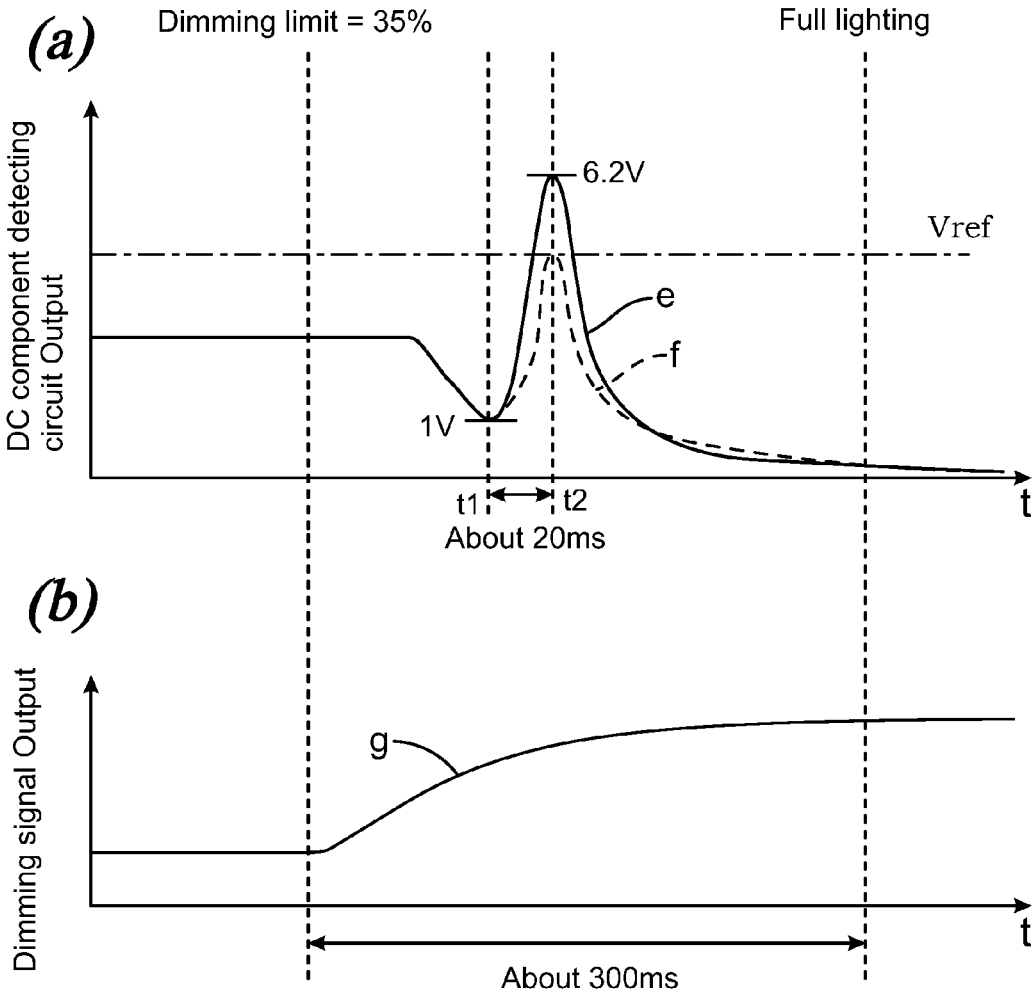
FIGS. 5(*a*) and 5(*b*) are signal timing charts for the embodiment of FIG. 1.

FIG. 5 show an output waveform of each circuit in the case where the dimming level is switched from the dimming level of 35% to the full lighting level (that is, dimming level of 100%). FIG. 5(*a*) shows the output signal from the DC component detecting circuit 7 and FIG. 5(*b*) shows the dimming signal from the dimming circuit 8. In this figure, as represented by a solid line e, the output signal sharply rises from time t1 (1V at the time t1) and the peak value reaches 6.2 V at time t2 after about 20 ms from time t1. Although not shown, the peak value similarly is reached in about 20 ms as in the cases of the start value of the dimming level of 30% and 25%. Accordingly, in the case of the reference value Vref=5.0V, as represented by a broken line f, a periodic change in the output signal in the case where the peak value of the output signal becomes the reference value Vref is (5.0-1.0)/20=0.2 [V/ms], and this value may be set as the above-mentioned predetermined value. In general, in the case where the periodic change is smaller than this value (that is, an inclination is gradual), as shown in FIG. 4(*a*), the output signal does not exceed the reference value Vref. For this reason, an erroneous detection can be prevented. Here, it is preferred that a read cycle of the control operating circuit 12 is set to about 2 ms so as to read ten times in about 20 ms.

In general, in the present embodiment, by prohibiting the protection operation by the control operating circuit 12 in the case where the periodic change in the output signal outputted from the DC component detecting circuit 7 reaches the predetermined value or higher, it is possible to prevent the protection operation being performed when the discharge lamp FL is not at the end of life. Thereby, the electronic ballast A with an improved detection accuracy of the end of life can be provided.

Moreover, in the state where the periodic change in the output signal reaches the predetermined value or higher, in the case where the output signal exceeds the reference value Vref, the protection operation is restarted when the output signal falls below the reference value Vref, and in the case where the output signal does not exceed the reference value Vref, the protection operation is restarted when the periodic change amount in the output signal becomes negative. Thereby, since the period to prohibit the protection operation can be shortened while suppressing erroneous detection, a longer operation period to detect lamp EOL can be set, resulting in detecting lamp EOL without impairment. Moreover, since the output of the discharge lamp FL need not be changed over a longer time than the change time of the dimming signal as in the other protection schemes, in order to prevent malfunction of the protection function, a performance reduction with respect to the dimming operation can be prevented.

Furthermore, in the present embodiment, since the number of circuits can be reduced by forming the above-mentioned control circuit 4 and control operating circuit 12 as one integrated circuit component rather than forming them separately, the number of assembling steps can be also reduced. As a result, the electronic ballast A can be manufactured at a lower cost.

Figure 6:
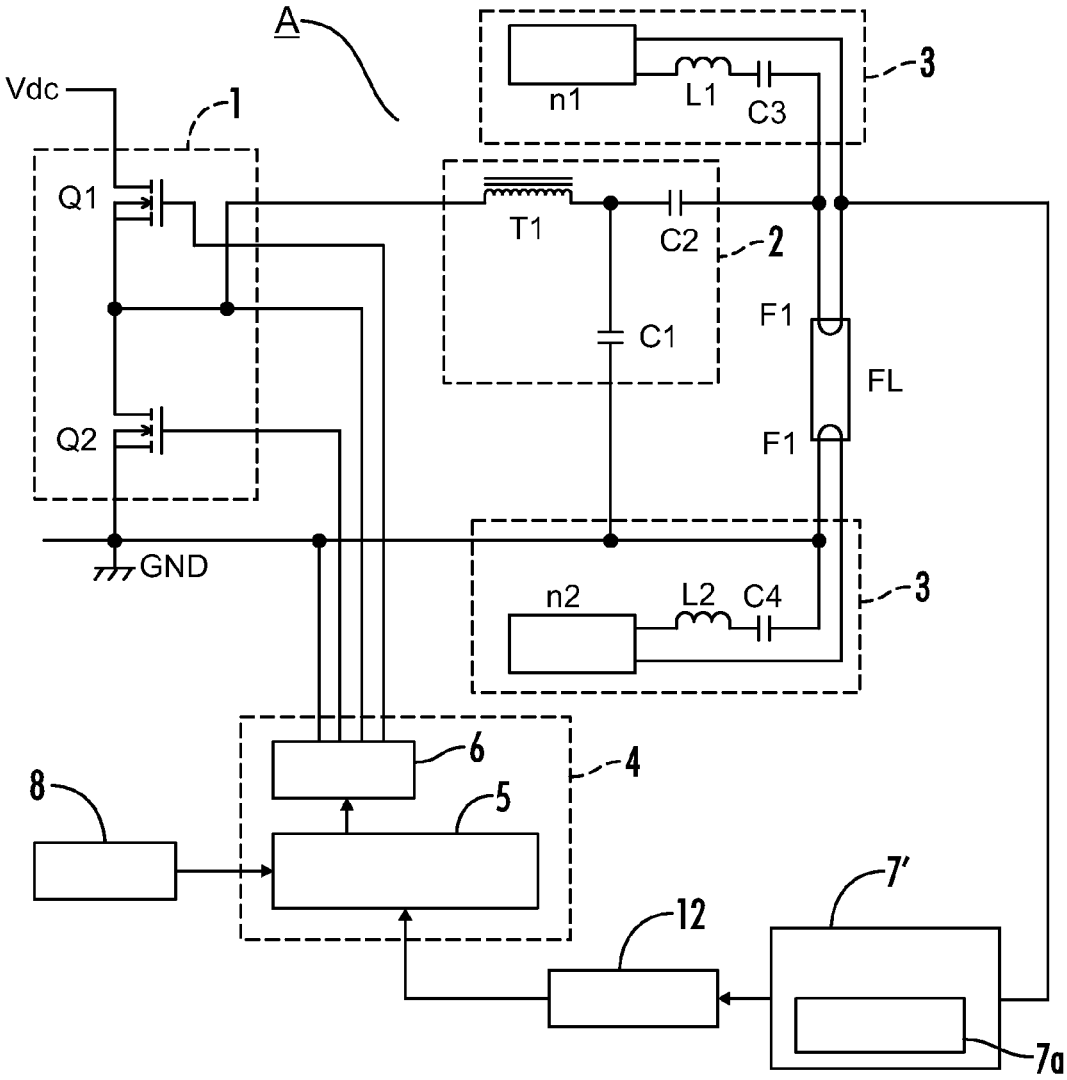
FIG. 6 is a circuit diagram of a second embodiment of an electronic ballast in accordance with the invention.

FIG. 6 is a circuit diagram showing a configuration of an electronic ballast A in accordance with a second embodiment. In the first embodiment, only the DC voltage component occurring in the discharge lamp FL is detected by the DC component detecting circuit 7, while in the present embodiment, a DC component detecting circuit 7' has an open filament detecting circuit 7*a* for detecting an open circuit at the filaments F1, F2. That is, since a DC voltage greatly exceeding the above-mentioned reference value Vref occurs in the case where any of the filaments F1, F2 breaks, the inverter circuit 1 can be protected by detecting the DC voltage. The embodiment of FIG. 6 is otherwise similar to the first embodiment and thus, the same elements are given a same reference numerals and description thereof is omitted.

Figure 7:
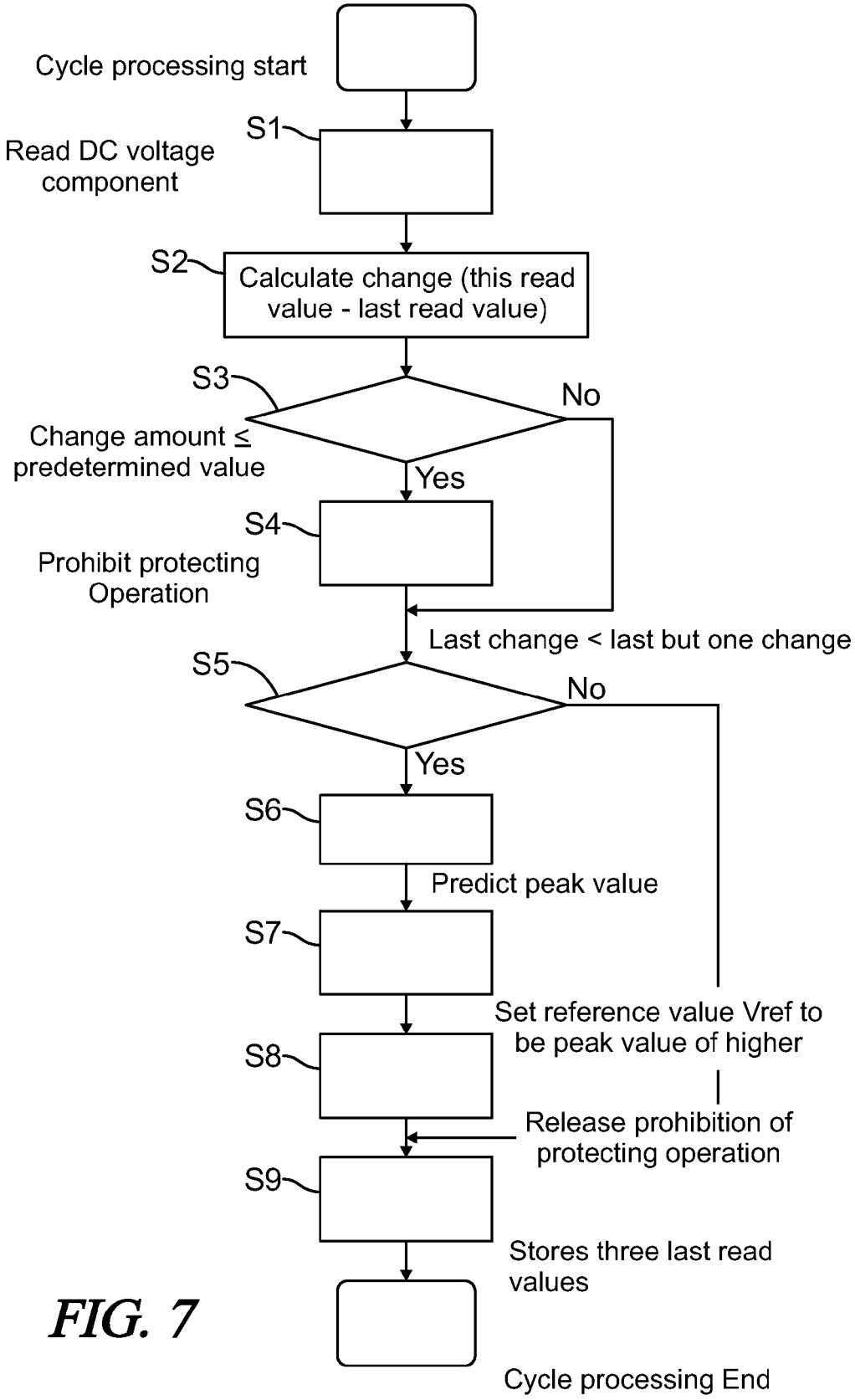
FIG. 7 is a flow chart explaining the operation of a control circuit used in the present invention.

FIG. 7 is a flow chart showing the control operating circuit 12 in the present embodiment, in which when a predetermined period passes, the control operating circuit 12 reads an output signal of the DC component detecting circuit 7' (Step S1). Next, the control operating circuit 12 calculates a periodic change in the output signal based on this read output signal value and a last read output signal value (Step S2) and prohibits the protection operation when the periodic change amount reaches the predetermined value or higher (Step S3) (Step S4). In the case where the above-mentioned periodic change amount falls below the predetermined value (Step S3), the control operating circuit 12 does not prohibit the protection operation and proceeds to Step S5.

Moreover, at Step S5, in the case where a last calculated periodic change amount is smaller than a previous calculated periodic change amount, the control operating circuit 12 predicts the peak value of the DC voltage component on the basis of last three read values (Step S6), sets the reference value Vref to a value higher than the peak value (Step S7), and releases the prohibiting state of the above-mentioned protection operation (Step S8). Then, after storing the three last read values in a memory (not shown) (Step 9), the control operating circuit 12 compares this read value with the reference value Vref in the case where the protection operation is not prohibited. As a result, when the read value exceeds the reference value Vref, the control operating circuit 12 executes the protection operation.

At Step S5, when the last calculated periodic change amount reaches the previous calculated periodic change amount or higher, the control operating circuit 12 stores the last three read values in the memory (Step S9) and compares the read value and the reference value Vref. As a result, when the read value exceeds the reference value Vref, the control operating circuit 12 executes the protection operation. Moreover, when the next predetermined period passes, a similar process is performed beginning at Step S1 and after that, the above-mentioned operations are repeated for every predetermined period.

That is, the present embodiment is different from the first embodiment in that the control operating circuit 12 stores the output signal from the DC component detecting circuit 7 three times. When the last periodic change amount falls below the previous periodic change amount, it predicts the peak value of the DC voltage component, resets the reference value Vref to a value higher than the peak value and releases a prohibited state of the protection operation. When the filament F1 (or filament F2) breaks, the DC voltage component greatly exceeds the peak value. For this reason, the control operating circuit 12 resets the reference value Vref to be higher than the peak value and releases the prohibited state of the protection operation to protect the inverter circuit 1. In the present embodiment, in the case where the output signal from the DC component detecting circuit 7' falls below the original reference value Vref, the reference value Vref is reset to the original reference value Vref (that is, the reference value for detecting the end of life).

Figure 8:
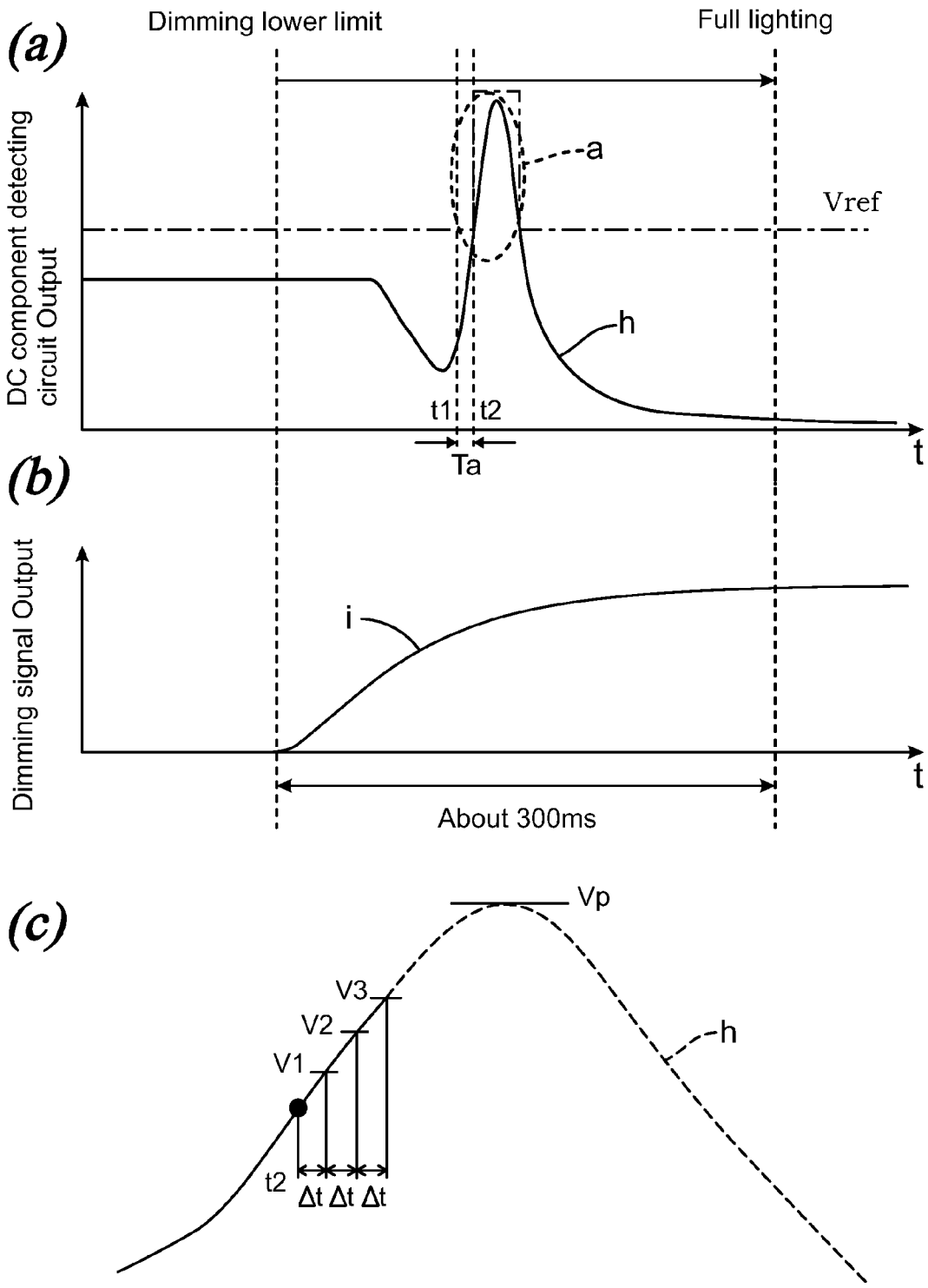
FIGS. 8(*a*), 8(*b*) and 8(*c*) are signal timing charts for the embodiment of FIG. 6.

FIGS. 8(*a*) and (*b*) show an output waveform of each circuit at the time when the switch 8*b* (FIG. 2) switches the dimming level of the discharge lamp FL from a dimming lower limit level to the full lighting level. FIG. 8(*a*) shows the output signal from the DC component detecting circuit 7' and FIG. 8(*b*) shows the dimming signal from the dimming circuit 8. In this figure, as represented by a solid line h, the periodic change in the output signal becomes the predetermined value or higher at time t1 and the protection operation is prohibited. However, since the last calculated periodic change amount falls below the previous calculated periodic change amount at time t2, the control operating circuit 12 predicts the peak value of the DC voltage component on the basis of the last three read values stored in a memory, resets the reference value Vref to a value higher than the peak value and releases the prohibited state of the protection operation. That is, in the present embodiment, the protection operation is prohibited only in a period Ta from time t1 to time t2. Here, since a parabola is described in the case where an abnormal DC component is superimposed, if three DC voltage components are recognized from a time when the periodic change amount decreases, the peak value can be obtained.

A method of setting the reference value Vref will be described below. In the enlarged view of FIG. 8(*c*), for example, providing that from time t2 when the last periodic change amount falls below the previous periodic change amount, a first read output signal value is V1, a second read output signal value is V2, a third read output signal value is V3, ΔV2=V2−V1, ΔV3=V3−V1 and the read cycle of the microprocessor is Δt. By approximating by a quadratic function, the peak value Vp of the DC voltage component is equal to $(4\times\Delta V2-\Delta V3)^2/(16\times\Delta V2-8\times\Delta 3)+V1$. Here, providing V1=3.00 [V], V2=3.50 [V], V3=3.97 [V], Vp is equal to 6.42 [V]. Thus, in this case, the reference value Vref should be set to 6.5 [V] or more.

In the case where the DC voltage component is instantaneously superimposed instantaneously, a superimposing time is about 20 ms from an actual measurement value in the first embodiment, and therefore, it is preferred that the read cycle Δt of the microprocessor is set to about 2 ms. Although it is approximated by a quadratic function in the present embodiment, the peak value can be obtained more accurately by approximating by a cubic function. In this case, however, it should be noted that the microprocessor needs to be operated at a higher speed since calculation amount increases.

In general, in the present embodiment, by resetting the reference value Vref to a value higher than the peak value predicted based on the periodic change amount of the output signal, it can be determined that the filament F1 (or filament F2) breaks in the case where the detected DC voltage component exceeds the reset reference value Vref and the protection operation is performed to protect the inverter circuit 1.

Figure 9:
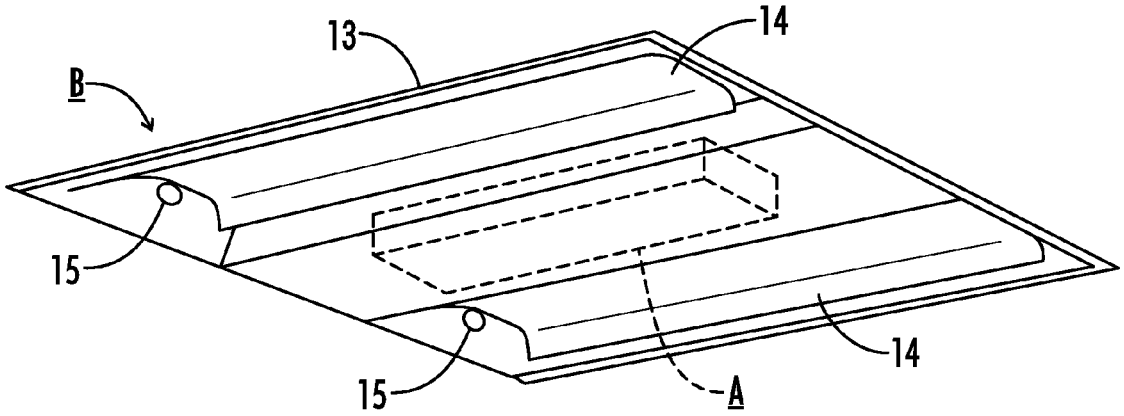
FIG. 9 is a perspective view of a lamp fixture in accordance with a third embodiment of the invention.
Figure 10:
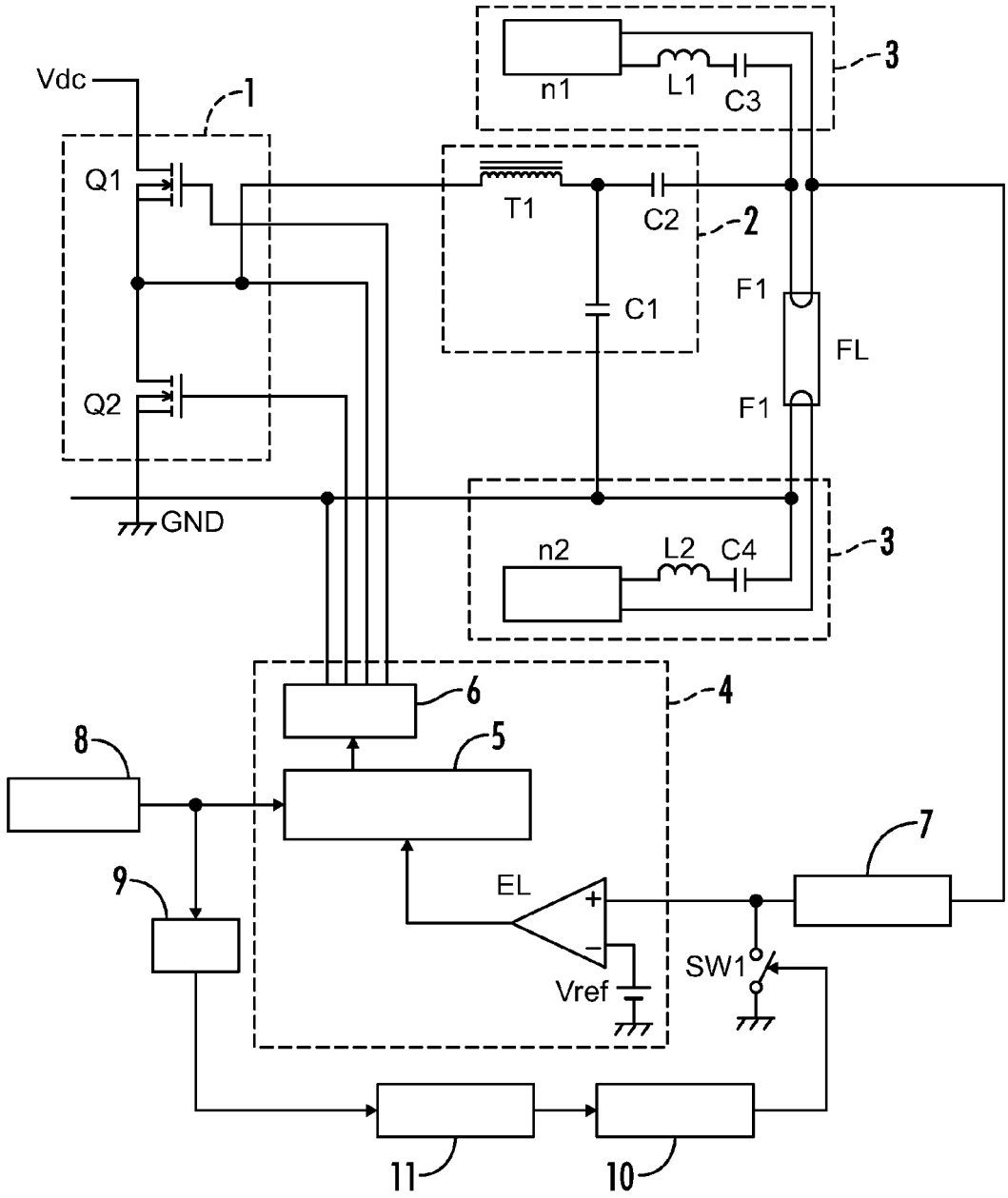
FIG. 10 (PRIOR ART)
FIG. 10 is a circuit diagram of an electronic ballast using a different EOL protection scheme.
Figure 11:
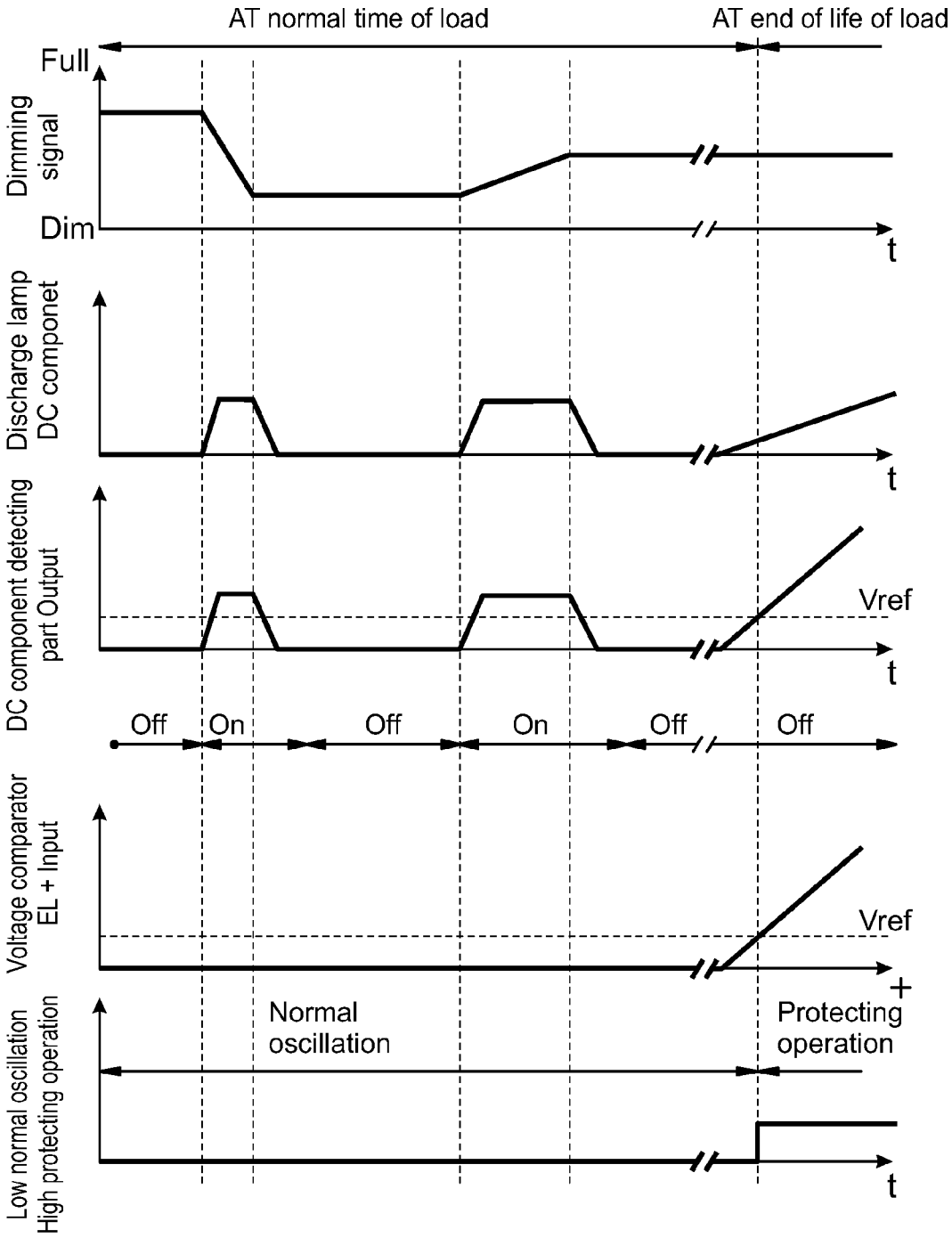
FIG. 11 (PRIOR ART)
FIG. 11 is a timing chart corresponding to operation of the electronic ballast of FIG. 10.
Figure 12:
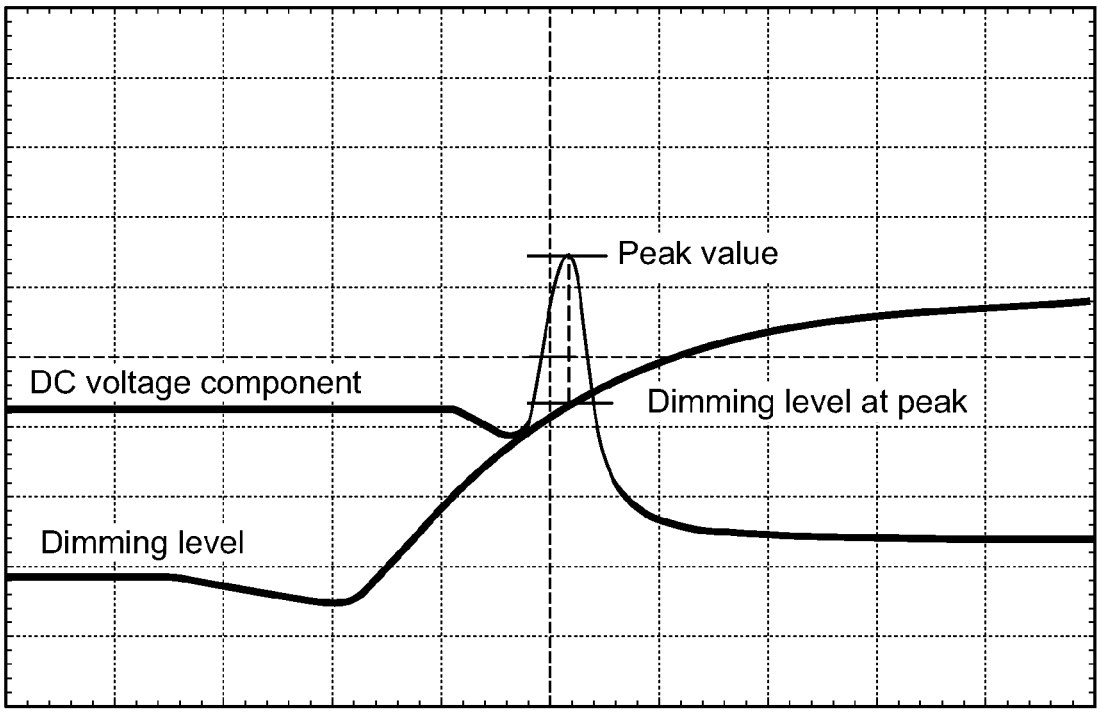
FIG. 12 (PRIOR ART)
FIG. 12 is a graph showing measurement results of a DC voltage component and a dimming level in the ballast of FIG. 10.

FIG. 9 shows a lighting fixture B in accordance with a third embodiment, which uses the electronic ballast A described in the first embodiment or the second embodiment.

The lighting fixture B in the present embodiment includes a rectangular fixture main body 13 having an electronic ballast A for dual lamp dimmed lighting therein. Reflective plates 14, 14 are arranged side by side on an upper surface of the fixture main body 1 and a pair of lamp sockets 15, 15 (only one is shown in FIG. 9) to which respective discharge lamps (not shown) are attached, are arranged under each of the reflective plates 14. An output terminal (not shown) of the electronic ballast A is electrically connected to each of the lamp sockets 15 via an electric wire (not shown) and lighting power is supplied to the respective discharge lamps via the lamp sockets 15.

In general, in the present embodiment, by using the electronic ballast A described in the first embodiment or the second embodiment, it is possible to provide a lighting fixture B which can prevent malfunction of the protection function at lamp EOL without impairing performance with respect to the dimming operation and detect the end of life of the discharge lamp without impairment.

In the present embodiment, although the electronic ballast A for dual lamp dimming control is used as an example of the electronic ballast, the electronic ballast is not limited to the present embodiment and two electronic ballasts for single lamp dimming control may be provided.

Thus, although there have been described particular embodiments of the present invention of a new and useful electronic ballast with lamp end of life detection and protection circuits, it is not intended that such references be construed as limitations upon the scope of this invention except as set forth in the following claims.

What is claimed is:

1. An electronic ballast comprising:

an inverter circuit with at least one switching element for converting a DC voltage into a high-frequency voltage;

a resonant circuit for lighting a discharge lamp at a high frequency by a resonant action, the resonant circuit being connected between both ends of the inverter circuit;

a control circuit for controlling an operation of the inverter circuit;

dimming circuit adapted to change an output voltage to the discharge lamp by changing an operating frequency of the inverter circuit;

DC component detecting circuit adapted to detect a DC voltage component of the discharge lamp;

protecting circuit adapted to detect an output signal of the DC component detecting circuit for every predetermined period and controlling the switching element so as to reduce or stop an output to the discharge lamp when the output signal exceeds a predetermined reference value; and operation prohibiting circuit adapted to prohibit an operation of the protecting circuit when a periodic change amount in the output signal of the DC component detecting circuit reaches a predetermined value or higher.

2. The electronic ballast according to claim 1 wherein, the operation prohibiting circuit prohibits an operation of the protecting circuit until the output signal falls below the predetermined reference value in the case where the periodic change amount in the output signal reaches a predetermined value or higher and the output signal exceeds the predetermined reference value, and prohibits the operation of the protecting circuit until the periodic change amount of the output signal becomes negative in the case where the periodic change amount of the output signal reaches the predetermined value or higher and the output signal does not exceed the predetermined reference value.

3. The electronic ballast according to claim 1 or 2 wherein, the operation prohibiting circuit predicts a peak value of the output signal on the basis of the periodic change amount of the output signal and sets the predetermined reference value to be higher than the predicted peak value in a period when the output signal exceeds the predetermined reference value.

4. The electronic ballast according to claim 1 or claim 2 wherein, the control circuit, the protecting circuit and the operation prohibiting circuit is formed of one integrated circuit component.

5. A lighting fixture comprising a fixture main body and further including an electronic ballast according to either claim 1 or claim 2.

* * * * *